United States Patent [19]

McNeal et al.

[11] Patent Number: 4,882,796

[45] Date of Patent: Nov. 28, 1989

[54] CONVERTIBLE BED FRAME

[76] Inventors: Ronald McNeal; Ida T. McNeal, both of 45 N. Mason, Chicago, Ill. 60644

[21] Appl. No.: 340,508

[22] Filed: Apr. 19, 1989

[51] Int. Cl.[4] ..... A47C 19/20; A47C 19/22

[52] U.S. Cl. ..... 5/8; 5/308; 5/400

[58] Field of Search ..... 5/400, 451, 308, 2 R, 5/401, 201, 200 R, 8

[56] References Cited

U.S. PATENT DOCUMENTS

| | | | |
|---|---|---|---|
| 1,815,616 | 7/1931 | Feldman | 5/308 |
| 4,180,878 | 1/1980 | Howell | 5/451 |
| 4,186,452 | 2/1980 | Underwood | 5/400 |
| 4,617,689 | 10/1986 | Nelson et al. | 5/308 |
| 4,656,681 | 4/1987 | Alexander et al. | 5/451 |
| 4,680,820 | 7/1987 | Bittner | 5/8 |
| 4,734,946 | 4/1988 | Saputo | 5/400 |
| 4,737,998 | 4/1988 | Johnson, Sr. | 5/451 |
| 4,745,646 | 5/1988 | Strobel | 5/451 |

*Primary Examiner*—Alexander Grosz

*Attorney, Agent, or Firm*—Hill, Van Santen, Steadman & Simpson

[57] ABSTRACT

A convertible bed frame has a first compartment holding a waterbed mattress and a platform that is selectively placeable over the first compartment to support a conventional mattress. To use the waterbed mattress, the conventional mattress and the platform are removed and stored in a storage compartment beneath the first compartment.

9 Claims, 1 Drawing Sheet

CONVERTIBLE BED FRAME

BACKGROUND OF THE INVENTION

1. Field of the Invention

The present invention relates generally to a frame for a bed and, more particularly, to a frame for a waterbed mattress.

2. Description of the Related Art

Waterbeds are well known and in common use. They generally include a liquid filled flexible envelope of vinyl or like material which forms the waterbed mattress, as well as frame including at least a platform supporting the mattress from below as well as sides for supporting the waterbed mattress laterally. Waterbed mattresses may be of different sizes and shapes although standard bed sizes, including twin, full, queen and king sizes, are most common.

Users of waterbeds enjoy the comfort and warmth of the heated waterbed mattress during sleep. However, the owner of a waterbed may occasionally be required to sleep on a conventional mattress either for comfort and convenience reasons or for medical reasons, such as a back injury. For example, during pregnancy, a woman may find it difficult to get in and out of a waterbed and so may require a conventional mattress. Since this condition is temporary, she may desire to have the waterbed back when she is no longer pregnant. This raises the problem of storing the waterbed and frame when the conventional bed is in use and, thereafter, storing the conventional mattress and frame when the waterbed is in use.

SUMMARY OF THE INVENTION

It is an object of the present invention to provide a bed which is quickly and readily convertible between a waterbed and a conventional bed.

Another object of the invention is to eliminate storage problems when two types of beds are alternately in use.

These and other objects of the invention are provided by a convertible bed frame having a first compartment containing a first mattress, and a platform removably implaceable over the first compartment for holding a second mattress. Preferably, the frame includes a storage compartment disposed beneath the first compartment into which the second mattress and the platform are placed during use of the first mattress. The advantages of the invention are realized when the first mattress in the first compartment is a waterbed mattress and the second mattress which rests on the platform and is alternately stored in the storage compartment is a conventional mattress. Since the conventional mattress is generally easier to move about than a waterbed mattress, the conventional mattress is, thus, used in the movable position (on top) and the waterbed mattress is used in the immovable position (in the first compartment).

Not only is the first mattress storable in the storage compartment when not in use, but also the platform on which the first mattress rests is stored in the storage compartment as well. The platform may either be a one-piece plank or board, or can be in two or more pieces to facilitate handling during conversion of the bed. Although separate platform pieces are each lighter and easier to move than a one-piece platform, it is preferred to hinge the pieces together for stability.

As used herein, waterbed mattress refers to a flexible compartment or envelope filled with a liquid, such as water or gel, and which may include various baffles or other wave damping means. A waterbed is a bed, possibly including a frame, which uses a waterbed mattress.

As used herein, conventional mattress refers to a coil spring mattress, sponge rubber mattress, fiber matting or the like, and conventional bed refers to a bed having a conventional mattress.

The present invention permits a waterbed to be easily and quickly converted to a conventional bed, or vice versa. Alternately, the apparatus can be used to convert from one conventional mattress to another conventional mattress of, for example, a different firmness. It is especially useful in a guest room to enable a bed to be converted from one type to another type as desired by the guest, all without requiring extra room for two types of beds. The present apparatus can be used in hospitals, hotels and motels, nursing rooms, and at home and may be made in a variety of sizes and shapes including the standard sizes for beds.

The convertible bed frame of the present invention is preferably of wood such as oak or maple which may be stained or painted in a variety of colors and which may include various decorations and attachments. For example, many waterbed frames include shelves, cabinets and lights. It is also contemplated to manufacture the frame of metal or other material.

DESCRIPTION OF THE PREFERRED EMBODIMENTS

Figure 1:
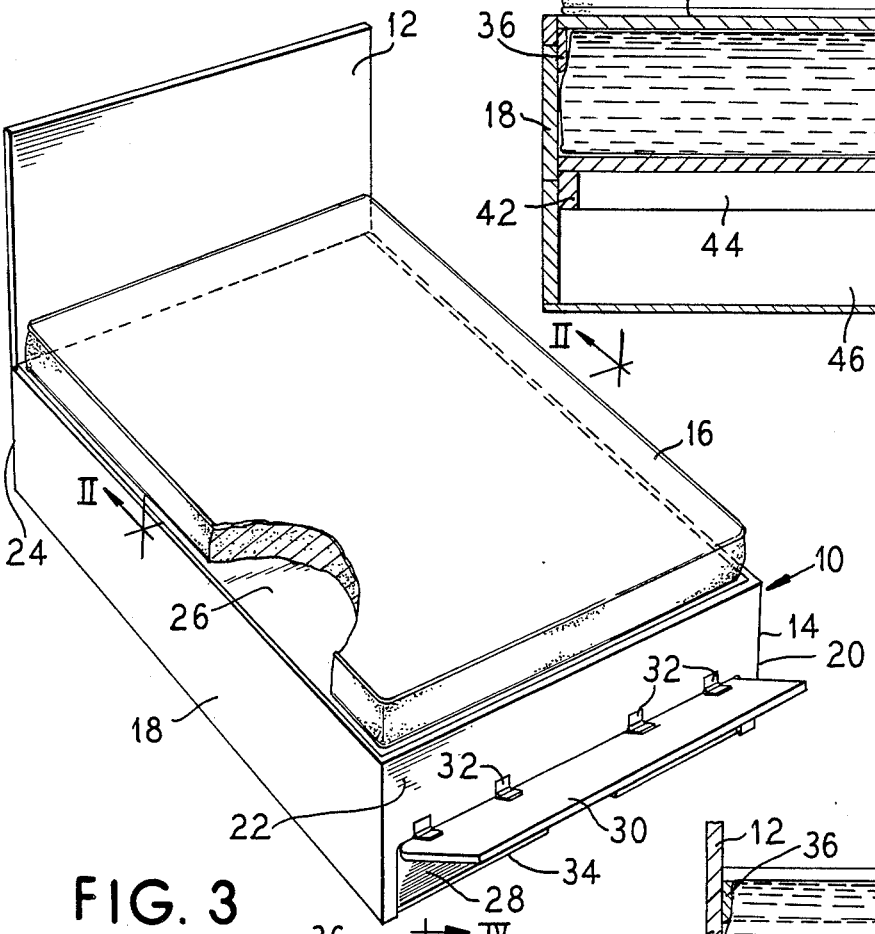
FIG. 1 is a perspective view of a convertible bed frame on which rests a conventional mattress in accordance with the principles of the present invention.

Referring first to FIG. 1, a convertible bed frame 10 of the present invention includes a headboard 12 and a base 14. The bed 10 may also include, in some embodiments, a footboard and/or a modified headboard having shelves, lights and like, as known. Resting on a top surface of the base 14 is a conventional mattress 16, which may either a coil spring mattress or a foam rubber mattress. Other types of mattresses may also be used.

The base 14 has opposite sidewalls 18 and 20, an end wall 22, and a head wall 24 which form a rectangular box. Lying atop the walls 18 through 24 is a platform 26 upon which the mattress 16 rests. In the end wall 22 is provided an opening 28 which is covered by a door or hatch 30, preferably attached to the end wall 22 by hinges 32. The bottom of the base may include a bottom plate or floor board 34 to enclose the bottom of the box.

Figure 2:
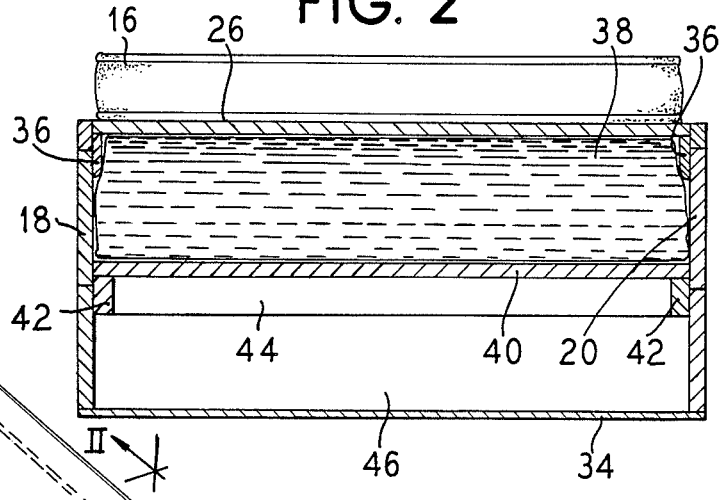
FIG. 2 is cross section along line II—II of FIG. 1 through the present convertible bed frame.

In FIG. 2 is shown a cross section of the waterbed of FIG. 1 including the conventional mattress 16 resting on the platform 26. The platform 26 in turn rests on inserts 36 extending along the inside surfaces of the sidewalls and end walls 18 through 24. Preferably, the inserts 36 are mounted spaced from the top of the sidewalls 18 through 24 by a distance equal to the thickness of the platform 26 so that when the edges of the platform 26 are resting on the inserts 36 the top of the platform 26 is flush with the top edges of the walls 18 through 24.

Beneath the platform 26 is a waterbed mattress 38 filled with water or other liquid. The waterbed mattress 38 rests on a support 40 which is supported not only at the edges by inserts 42 but also by joists 44 extending across the width of the support 40. The joists 44, or other supporting means, are important since, for example, a queen size waterbed mattress can weigh up to 1,100 pounds when filled with water and a sturdy support is, therefore, required. Between the joists 44 and the floor board 34 is a storage space 46 which is at least as big as the conventional mattress 16 and preferably slightly larger so as to hold the platform as well.

The illustrated convertible bed frame is of wood planks and sheets fastened together by known fastening means, including nails, screws, glue, dowel pins, dovetail slots, etc. as desired. Other construction techniques are, of course, possible, as are other materials, which are within the scope of the present invention.

Figure 3:
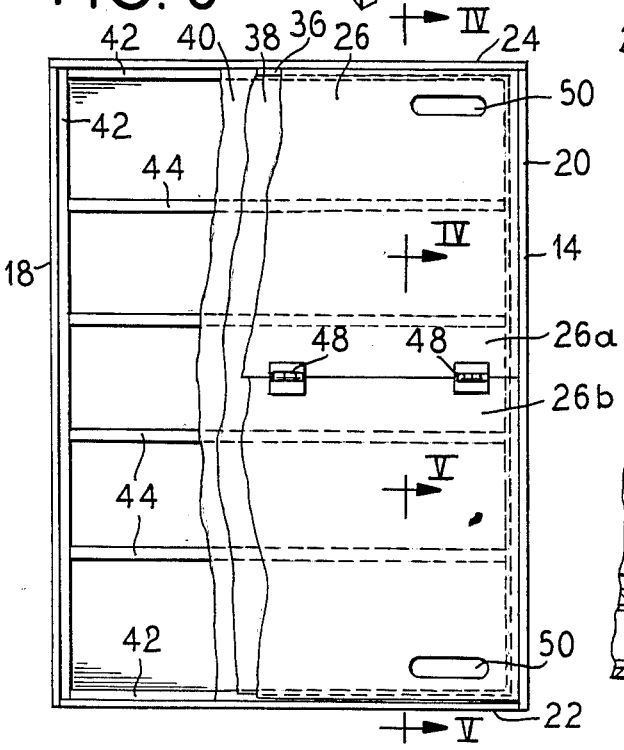
FIG. 3 is a top plan view of the present bed frame with the conventional mattress removed and shown partially cut away.

The top view of FIG. 3 shows a cut-away through the platform 26, the waterbed mattress 38, and the support 40 to reveal the joists 44 extending across the width of the base 14 between the sidewalls 18 and 20. Of significance in FIG. 3 is the platform 26 which is divided into two parts 26*a* and 26*b* that are connected to one another by one or more hinges 48. Standard hardware hinges can be used, including a piano hinge as one possibility. It is also possible to eliminate the hinges 48 so that the two portions 26*a* and 26*b* of the platform 26 are separable from one another. This makes them lighter and easier to handle individually as compared to a one-piece platform or pieces hingedly connected to one another. It is also contemplated to divide the platform into three, four or more parts. Strengthening members may also be provided in or attached to the platform elements.

Figure 4:
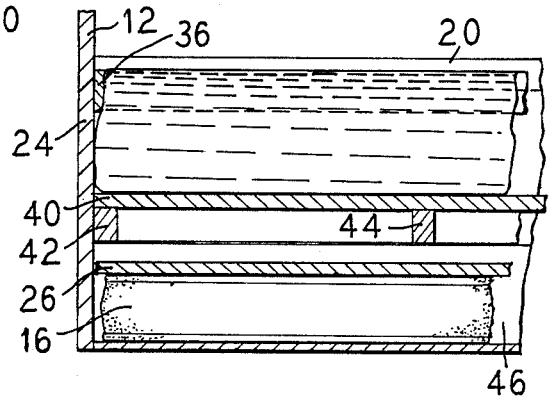
FIGS. 4 and 5 are vertical cross sections generally along lines IV—IV and V—V, respectively, of FIG. 3.

In FIG. 4 is shown the convertible bed frame set up for use of the waterbed mattress 38. The platform 26 has been removed from the top of the base 14 and, along with the conventional mattress 16, is stored in the storage space 46. 0f course, the top edges of the sidewalls 18 and 20 and end wall 22 may be provided with padding other cushioning material as is known.

Figure 5:
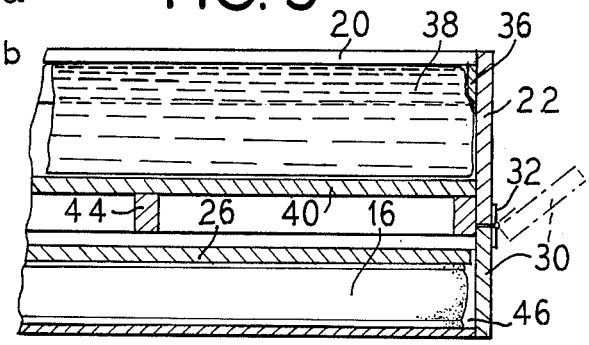

In FIG. 5 it can be seen that the door or hatch 30 is of generally the same height as the storage area 46 so that the mattress 16 and platform 26 can be easily inserted and removed.

It is contemplated that the platform 26 may have handles, handle holes, or straps and the like by which it is grasped for removal from the base 14. For example, handle holes 50 are shown in FIG. 3.

Although other modifications and changes may be suggested by those skilled in the art, it is the intention of the inventors to embody within the patent warranted hereon all changes and modifications as reasonably and properly come within the scope of their contribution to the art.

We claim:

1. A convertible bed frame, comprising:

a first compartment having a lower support plane and surrounding lateral walls, said first compartment adapted for holding a first mattress;

a second compartment disposed beneath said first compartment and adapted for holding a second mattress said second compartment having an external opening in one of its sides, a platform being changeable from a fully extended supporting size that is adapted to cover said first compartment and support the second mattress when it is placed thereon, to a reduced storable size that permits said platform to be inserted through said external opening for storage in said second compartment.

2. A convertible bed frame as claimed in claim 1, wherein said platform is of a plurality of platform elements.

3. A convertible bed frame as claimed in claim 2, further comprising: means fastening said plurality of platform elements to one another.

4. A convertible bed frame as claimed in claim 3, wherein said means for fastening includes at least one hinge mounted between said platform elements.

5. A convertible bed frame as claimed in claim 1, wherein said surrounding lateral walls of said first compartment have recessed support means for supporting said platform.

6. A convertible bed frame for supporting a waterbed mattress and a conventional mattress, comprising:

a rectangular base having lateral walls and a floor board, the rectangular base having a planar support member dividing said base into first and second compartments, said first compartment being accessible from above and adapted to hold the waterbed mattress;

a hatch formed in one of said lateral walls to provide access to said second compartment; and a platform selectively resting on said base to close said first compartment from above, said platform having a planar upper surface adapted to support the conventional mattress, said platform being removable from on said base and changeable in size from an extended supporting size to a reduced storage size that is insertable into said second compartment through said hatch.

7. A convertible bed frame as claimed in claim 6, further comprising:

a door selectively closeable over said hatch.

8. A convertible bed frame as claimed in claim 6, wherein one of said lateral walls is a headboard.

9. A convertible bed frame as claimed in claim 6, wherein said platform is in two pieces that are connected by hinges.

* * * * *